10/15/85 OR 4,546,512

United States Patent [19]

Liebscher et al.

[11] Patent Number: 4,546,512

[45] Date of Patent: Oct. 15, 1985

[54] MECHANICAL SWEEPER

[75] Inventors: Johannes Liebscher, Nassau; Rolf G. Schülein, Singhofen, both of Fed. Rep. of Germany

[73] Assignee: Leifheit AG, Nassau, Fed. Rep. of Germany

[21] Appl. No.: 555,907

[22] Filed: Nov. 29, 1983

[30] Foreign Application Priority Data

Mar. 24, 1983 [EP] European Pat. Off. ..... 83102925.1

[51] Int. Cl.[4] ..... A47L 11/33

[52] U.S. Cl. ..... 15/41 R; 301/111

[58] Field of Search ..... 15/41–48; 301/105 R, 111, 125

[56] References Cited

U.S. PATENT DOCUMENTS 3,246,353 4/1966 Farnsworth ..... 15/41 R 3,248,154 4/1966 Waters et al. ..... 15/41 R

FOREIGN PATENT DOCUMENTS 2082448 3/1982 United Kingdom ..... 15/41 R

*Primary Examiner*—Edward L. Roberts

*Attorney, Agent, or Firm*—Frishauf, Holtz, Goodman & Woodward

[57] ABSTRACT

Mechanical sweeper with slotlike bearing bores with introduction slits in partition walls and outwardly open wheel recesses in the housing wherein the drive/running wheels are closed externally with a smooth surface and are retained by check plates and retaining pockets on the partition walls.

5 Claims, 4 Drawing Figures

MECHANICAL SWEEPER

BACKGROUND OF THE INVENTION

The invention relates to a mechanical sweeper of the type including a housing, brush means, a dirt-collecting receptacle and means for moving the housing over a surface to be swept.

A mechanical sweeper of this type is known from German Pat. No. 2,259,964. However, the mounting of the axles for the drive/running wheels is very complicated and difficult to assemble.

SUMMARY OF THE INVENTION

The aim of the invention is to produce a mechanical sweeper wherein the axles are mounted in such a way that simple assembly is possible and also the housing can be recessed in the region of the drive/running wheels.

This aim is achieved by providing means for supporting the housing on the surface to be cleaned which includes an assembly having at least one axle with end portions and means for bounding a slot in each of the oppositely located lateral walls of the housing, each slot having an open end for removably introducing the respective end portions of the axle into the slot. By this mounting of the axles, it is possible to simply plug the drive/running wheels onto the axles. The axles themselves are assembled extremely rapidly through the slots.

Due to the possibility of merely plugging the drive/-running wheels onto the axles, it is also possible to make the latter externally smooth. This also particularly fulfills stylistic demands, according to which the drive/-running wheels should be freely visible. Apart from that, this also has advantages in cleaning the appliance. The construction of the bearing bore as an L-shaped introduction slot creates further security in the bearing in addition to simple assembly. Even under extreme loads, caused by somewhat inexpert handling, the axle cannot jump out.

BRIEF DESCRIPTION OF THE DRAWING

Above-mentioned and other features and objects of this invention will become more apparent by reference to the following description taken in conjunction with the accompanying drawing in which.

DESCRIPTION OF THE PREFERRED EMBODIMENT

Figure 1:
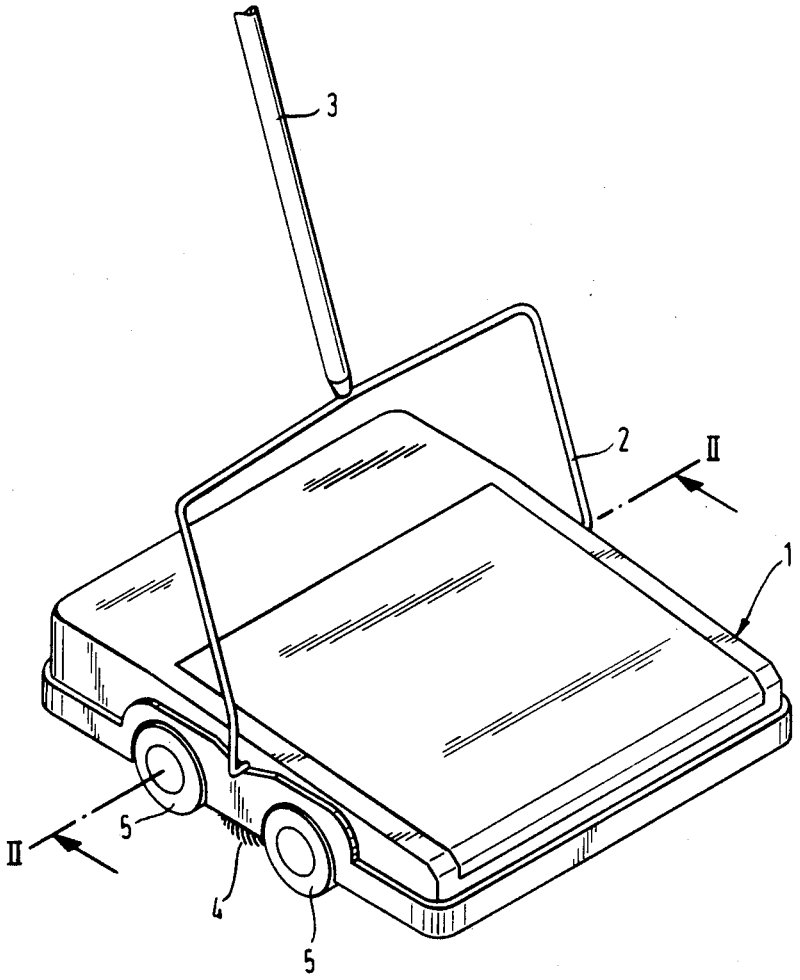
FIG. 1 shows a general view of the mechanical sweeper according to this invention.
Figure 2:
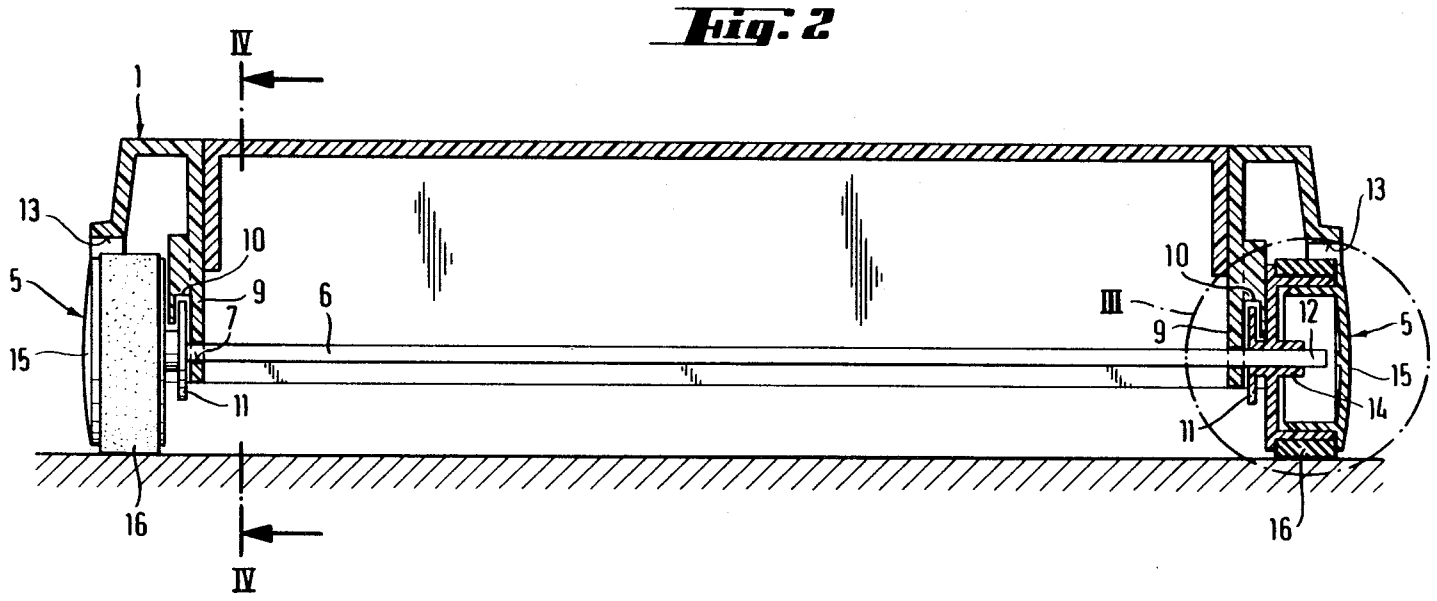
FIG. 2 shows a section along the line II—II of FIG. 1, the drive/running wheel being shown in elevation on the left and in section on the right.
Figure 3:
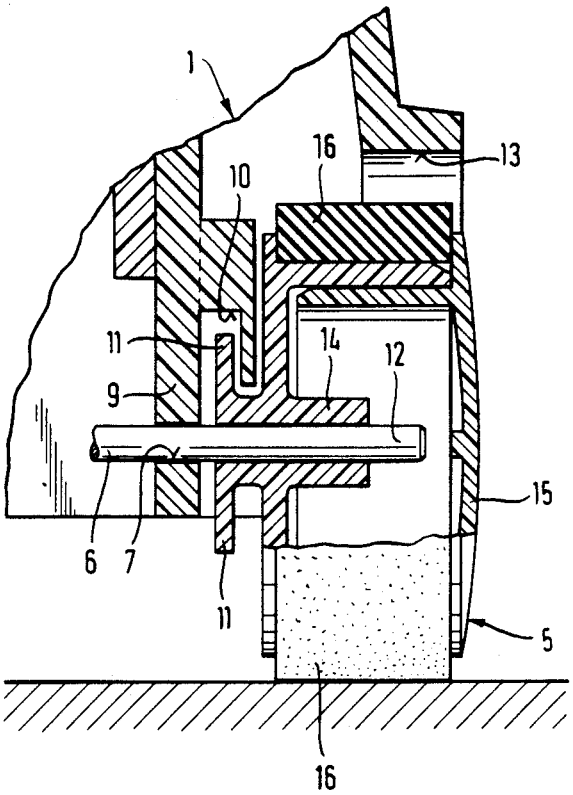
FIG. 3 shows a detail on a larger scale according to the detail III of FIG. 2.
Figure 4:
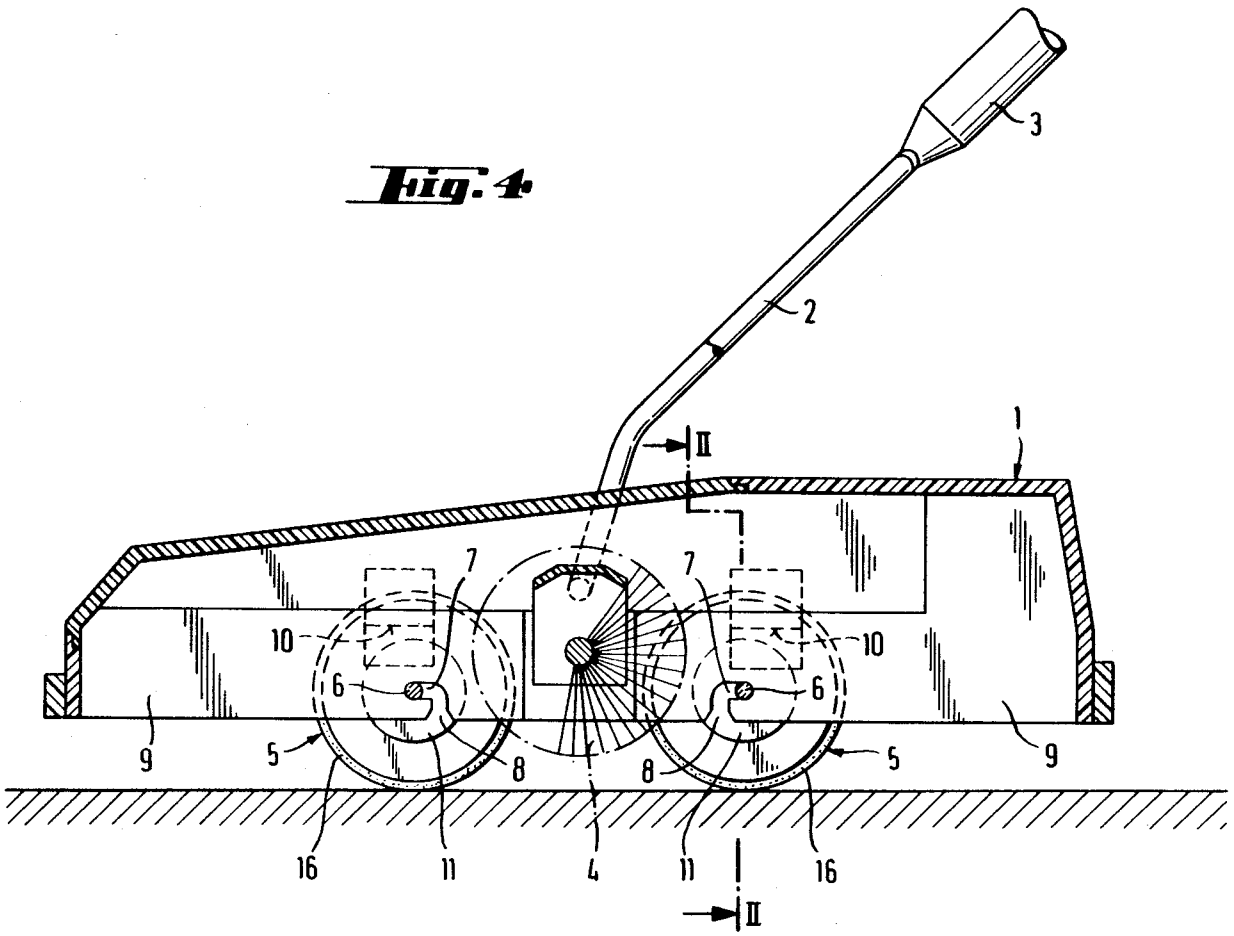
FIG. 4 shows a section along the line IV—IV of FIG. 2.

The sweeper comprises, externally, substantially of a housing 1, a handle yoke 2 with a handle 3, a cylindrical brush 4, drive/running wheels 5 and axles 6 supporting the latter.

The axles 6 are accommodated by slotlike bearing bores 7 which merge into introduction slot 8. The axles 6 are prevented from falling out by the counterpressure of the cylindrical brush 4 or by a friction wheel, not shown in detail. The bearing bores 7 are located in lateral or partition walls 9 of the housing 1.

Retaining pockets 10, in which check plates 11 of the drive/running wheels 5 engage, are molded on the partition walls 9. Projections 11 extend from the partition wall 9 and the retaining pockets 10 are formed by the projections 11 and the partition wall 9. It is thereby possible for the drive/running wheels to be placed on the ends 12 of the axles 6 with no additional retaining device.

The housing 1 is recessed in the region 13 of the drive/running wheels 5. The drive/running wheels 5 are provided with a bearing hub 14 on one side only. The outwardly facing part is closed in a smooth surface with a guard cap 15. This guard cap 15 serves simultaneously as retaining means for the running wheel tire 16.

While we have described above the principles of our invention in connection with specific apparatus, it is to be clearly understood that this description is made only by way of example and not as a limitation to the scope of our invention as set forth in the objects thereof and in the accompanying claims.

We claim:

1. A mechanical sweeper of the type including a housing having two oppositely located lateral walls, brush means connected to the housing, a dirt-collecting receptacle positioned in the housing and means for moving the housing over a surface to be cleaned, comprising:

means for supporting the housing on the surface to be cleaned including an assembly having at least one axle with end portions and a wheel mounted on each of said end portions, said wheel having an inner surface including a radially extending projection, the lateral walls each including a slot for removably introducing a respective one of said end portion of said axle into said slot; and oppositely located protrusions, each of said protrusions extending outwardly from a respective one of the lateral walls and being parallel to and spaced from said respective one of the lateral walls, said wheel projection being positioned and confined between a respective one of the lateral walls and protrusions after introduction of said axle into said slot.

2. The sweeper as claimed in claim 1 wherein said wheel has a substantially flat outer surface.

3. The sweeper as claimed in claim 2 wherein said housing further includes outer walls each extending laterally outwardly from a respective one of the lateral walls and each being substantially parallel to the respective one of the lateral wall and spaced outwardly from said projections, and wherein said housing is recessed in each of said outer walls thereof for accommodating a respective wheel.

4. The sweeper as claimed in claim 1 wherein each of said slots includes a section in which said axle is retained when mounted on said housing, and wherein said section communicates with said open end.

5. The sweeper as claimed in claim 4 wherein said slot is L-shaped, said open end forming one, and said section forming the other, leg thereof.

* * * * *